US006095960A

United States Patent [19]

Achelpohl

[11] Patent Number: 6,095,960

[45] **Date of Patent: *Aug. 1, 2000**

[54] METHOD AND DEVICE FOR MANUFACTURING BAGS FROM TUBULAR PAPER SECTIONS OF A SINGLE LAYER OR MULTIPLE LAYERS

[75] Inventor: Fritz Achelpohl, Lienen, Germany

[73] Assignee: Windmöller Hölscher, Lengerich, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/769,431

[22] Filed: Dec. 19, 1996

[30] Foreign Application Priority Data

Dec. 21, 1995 [DE] Germany ..... 195 48 110

[51] Int. Cl.[7] ..... B31B 1/64; B31B 49/04

[52] U.S. Cl. ..... 493/189; 493/205; 493/215; 493/219; 493/220

[58] Field of Search ..... 493/189, 193, 493/205, 214, 215, 218, 219, 220, 231, 243, 245, 248, 253, 255, 260, 261, 262, 263, 264, 267, 309, 333, 334, 335, 374, 379, 380, 386, 417, 446, 447, 453, 918, 936

[56] References Cited

U.S. PATENT DOCUMENTS

| | | | |
|---|---|---|---|
| 2,953,976 | 9/1960 | Hahn . | |
| 3,043,199 | 7/1962 | Niemeyer . | |
| 3,103,856 | 9/1963 | Rawe . | |
| 3,133,480 | 5/1964 | Gerard | 493/197 |
| 3,237,534 | 3/1966 | Lissner . | |
| 3,567,111 | 3/1971 | Baxter . | |
| 3,664,238 | 5/1972 | Baxter . | |
| 3,853,040 | 12/1974 | Achelpohl . | |
| 3,927,606 | 12/1975 | Brockmuller . | |
| 3,967,544 | 7/1976 | Brock | 493/197 |
| 4,008,850 | 2/1977 | Goodrich . | |
| 4,301,961 | 11/1981 | Rodish . | |
| 4,358,332 | 11/1982 | Rodish . | |
| 4,376,670 | 3/1983 | Rodish . | |
| 5,006,186 | 4/1991 | Yokoyama . | |
| 5,102,383 | 4/1992 | Achelpohl | 493/226 |
| 5,236,531 | 8/1993 | Yokoyama . | |
| 5,688,218 | 11/1997 | Jenkins | 493/151 |

FOREIGN PATENT DOCUMENTS

| | | |
|---|---|---|
| 1 005 820 | 4/1957 | Germany . |
| 1 611 702 | 11/1971 | Germany . |
| 2 055 016 | 1/1973 | Germany . |
| 2359364A1 | 6/1975 | Germany . |

*Primary Examiner*—Eugene Kim
*Attorney, Agent, or Firm*—Evenson, McKeown, Edwards & Lenahan, P.L.L.C.

[57] ABSTRACT

When manufacturing bags from tubular paper sections of a single layer or multiple layers, at least one end of each flat, tubular section is expanded into a bottom square. Lateral flaps formed in this way are folded such that they overlap and partially cover corner flaps. In order to easily bond expanded bottom squares together, the regions of the tubular sections which are to be bonded together are provided with coatings of thermoplastic which are heated and pressed together.

6 Claims, 11 Drawing Sheets

METHOD AND DEVICE FOR MANUFACTURING BAGS FROM TUBULAR PAPER SECTIONS OF A SINGLE LAYER OR MULTIPLE LAYERS

BACKGROUND OF THE INVENTION

1. Field of the Invention

This invention pertains to a method for manufacturing bags from flat, tubular paper sections of a single layer or multiple layers. At least one end of each flat, tubular paper section is expanded into a bottom square. Lateral flaps, formed in this way, are folded such that they overlap one another and partially cover corner flaps. The lateral flaps are subsequently bonded together.

2. Description of Related Art

In the manufacture of bags, bonding of overlapping lateral flaps of an expanded bottom square to one another and to corner flaps presents a particular problem because the bond used should be firm and secure in order to obtain a tight and stable bottom. However, the bond should also be produced in the simplest possible fashion so as to reduce the mechanical effort required for bond production on the bottom of the bag. It is known to apply patterns of an adhesive, such as a cold-bonding agent or hot-melt, to the lateral flaps. However, such a patterned adhesive application requires significant mechanical effort and continuous maintenance of devices that supply the adhesive. Consequently, the invention has as an objective the development of a method which makes it possible to fold and bond together expanded bottom squares of paper bags in a particularly simple fashion.

SUMMARY OF THE INVENTION

According to the invention, this objective is attained with a method in which tubular sections are provided with coatings of thermoplastic within the regions that are to be bonded together. The aforementioned coatings are then heated and pressed together.

According to such a method, the bottoms of the paper bags can be tightly bonded together while being folded by entirely or partially providing the regions to be bonded together with a coating of thermoplastic that, after being heated and plasticized, bonds to itself in a superior fashion. The plastic coatings are applied to the paper in conventional fashion. The thermoplastic coating can, for example, consist of polyethylene (PE).

It is practical to provide the overlapping lateral flap with a coating of thermoplastic within the edge region of its inner side. This makes it possible to attain a superior bond between the overlapping lateral flap and an outer side of the overlapped lateral flap, particularly if the tubular section is provided with a plastic coating over its entire outer side.

According to a preferred embodiment of the invention, the outer side of the closed bottom, which is provided with a coating of thermoplastic, is heated. A bottom cover sheet, having a side facing the bottom which is coated with thermoplastic and previously heated, is pressed onto the bottom. This bottom cover sheet eliminates the need to coat the inner side of the overlapping lateral flap and results in a particularly tight and stable bond between the bottom cover sheet and the bottom.

Instead of applying plastic coatings to the outer side portions of the tubular sections, it is possible to provide entire outer sides of the tubular sections with coatings of thermoplastic. Such a coating additionally increases the stability of the bags and results in an improved resistance to moisture.

Naturally, the method according to the invention can also be advantageously utilized if the tubular sections consist entirely of a film of thermoplastic.

In addition, the method according to the invention can be used not only for bonding together the bottom of the paper bag while folded, but also for forming the longitudinally extending seams during the manufacture of the tubular sections from flat strips of material.

It is practical to convey the tubular sections with the expanded bottoms continuously while lying transversely. The regions that are to be bonded together are preferably conveyed over heating devices, such as heated sheet metals, plates or blades, that activate the regions that are to be bonded together by plasticizing the plastic coatings.

If bottom cover sheets are bonded to the folded bottoms, then the surfaces of the bottom and the bottom cover sheet which are to be bonded together are conveyed over heated plates.

A device for carrying out the method according to the invention comprises a conveyor that conveys the tubular sections with the expanded bottoms such that they lie transversely. The device is provided with a heated straight edge that is rigidly connected to a frame and serves to produce the lateral flaps. Guide rods and/or pressing rods fold the lateral flaps around the lateral edges of the straight edge which extend parallel to one another. A heated blade heats the regions of the lateral flaps which are to be bonded together and engages between the increasingly overlapping lateral flaps. The straight edge can have a cross section in the shape of an isosceles triangle or trapezoid. The height of the triangle or trapezoid preferably decreases in the transport direction.

In order to prevent one side of the bottom from bonding to an adjacent side wall of the flat bag, one embodiment has the bottom region of the tubular section conveyed over a table board. A separating plate is provided which is rigidly connected to the frame. This separating plate engages between one side of the bottom that is folded into the plane of the flat tubular section and the end region of the tubular section situated underneath.

It is practical to provide a pair of pressing rollers that is rigidly connected to the frame. Each bottom passes through this pair of pressing rollers after being folded and bonded. The parts that are to be bonded together are firmly pressed together in this way such that a superior bond is attained.

If an additional bottom cover sheet is to be applied to the folded bottom, then each folded bottom passes underneath a heating plate that is rigidly connected to the frame. A transport cylinder, rigidly connected to the frame, is arranged behind the heating plate as seen in the transport direction. This transport cylinder presses a bottom cover sheet onto the bottom of the bag. The side of the bottom cover sheet facing the bottom of the bag is provided with a heated coating of thermoplastic. Part of the circumference of the transport cylinder may be covered with a heated, curved shell in order to heat the thermoplastic coating.

According to an additional feature of the invention, the device comprises a conveyor that conveys the tubular sections with the expanded bottoms such that they lie transverse. Heated plates are arranged on endless conveying elements that revolve at the same speed as the conveyor as well as parallel to the conveyor. The heated plates are placed onto the inner regions of the corner flaps that are to be bonded to the outer regions to be folded. Parallel edges of the plates form the folding edges for the lateral flaps. In this case, guide rods, pressing rods or both guide and pressing rods are rigidly connected to the frame and are provided for forming the lateral flaps. The regions of the overlapping, folded lateral flaps which are to be bonded together move over heated blades that are rigidly connected to the frame. The heated plates are swung out in opposite directions before the bottoms are introduced between the pairs of pressing rollers.

BRIEF DESCRIPTION OF THE DRAWINGS

Several embodiments of the invention are described in detail below with reference to the figures.

DESCRIPTION OF THE PREFERRED EMBODIMENTS

Figure 1:
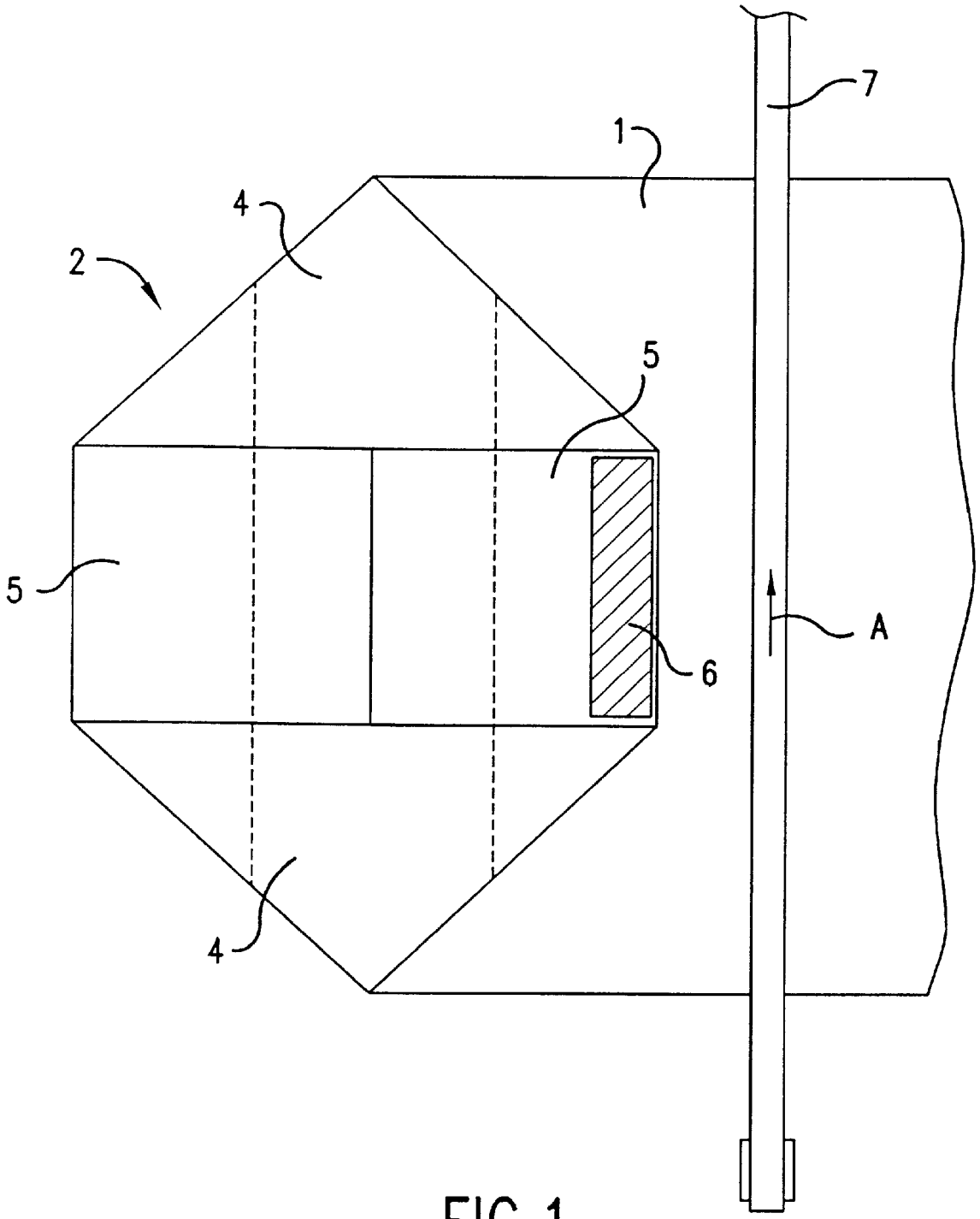
FIG. 1 is a top view of one side of a transversely conveyed, flat tubular section with an expanded bottom square.
Figure 2:
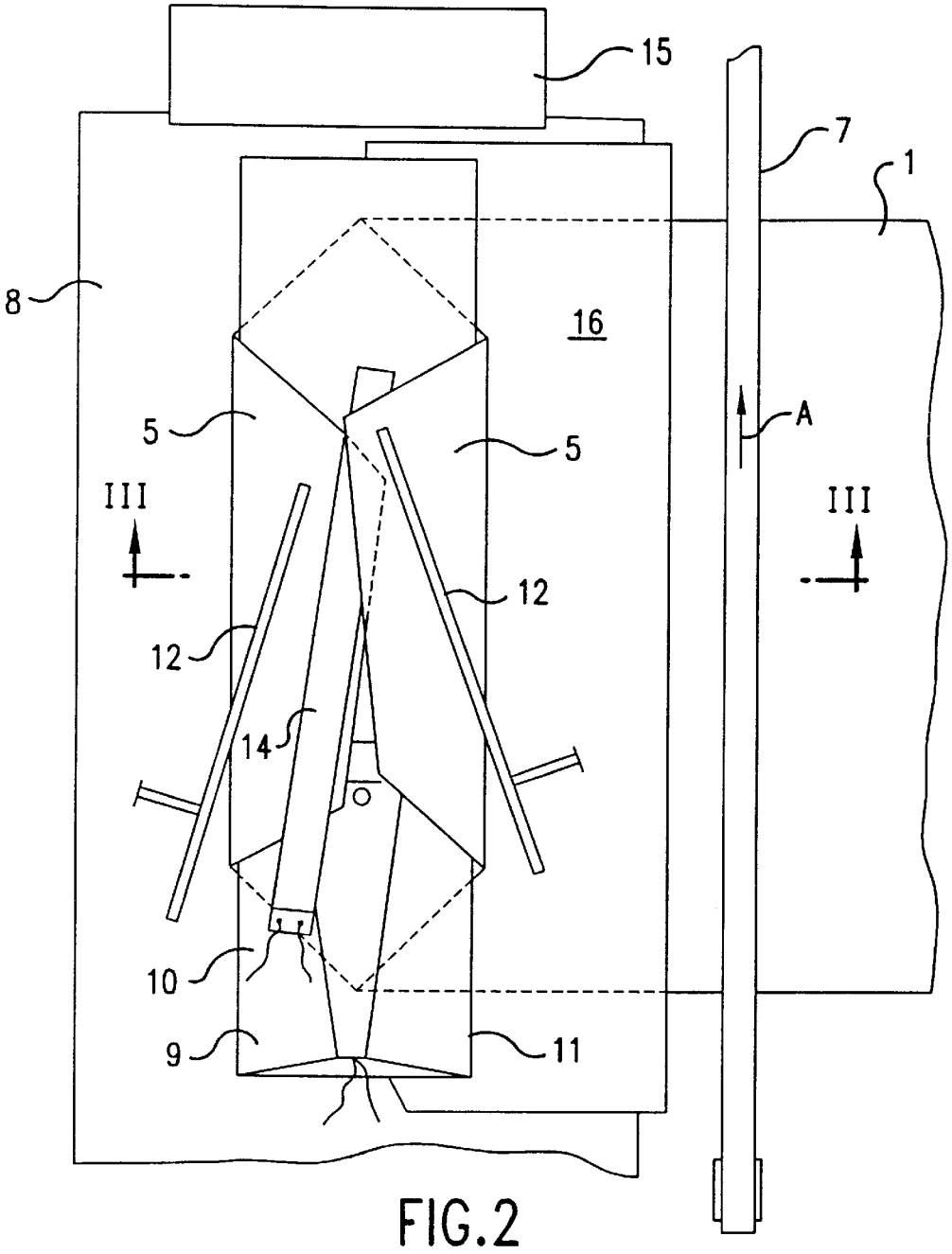
FIG. 2 is a schematic top view of a device for folding the lateral flaps of a bottom such that they overlap one another as well as the devices for heating the applied plastic coatings.
Figure 3:
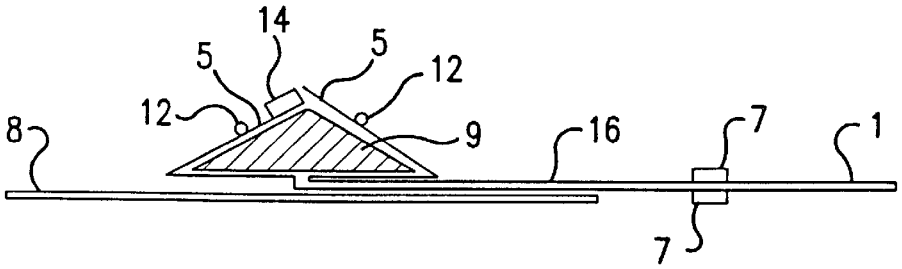
FIG. 3 is a section through the device along line III—III in FIG. 2.
Figure 4:
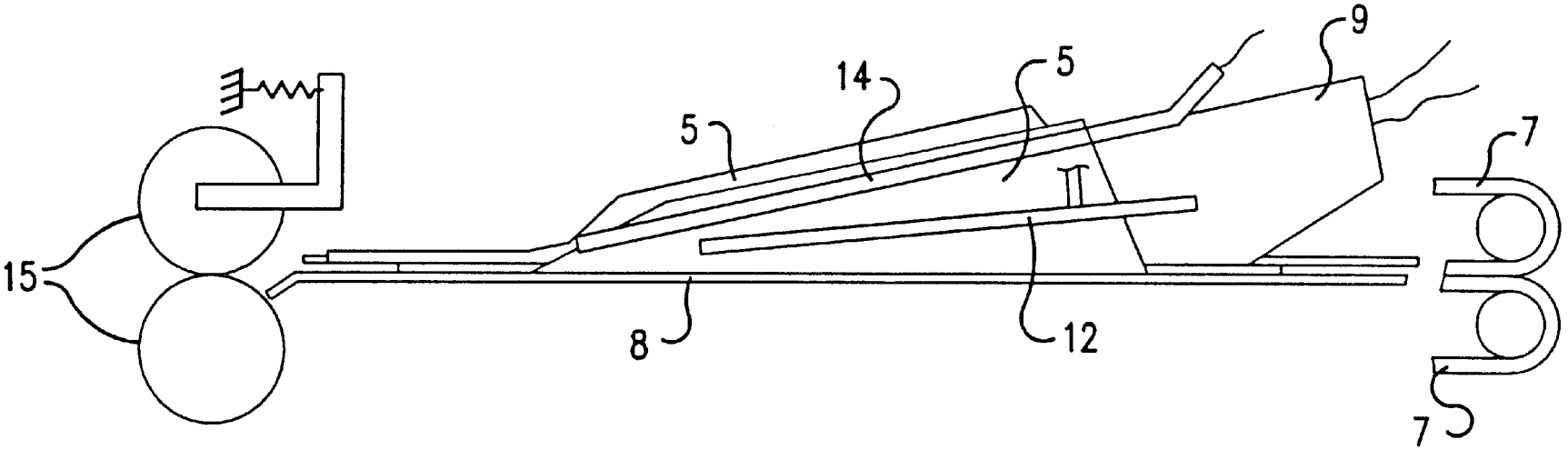
FIG. 4 is a side view of the device according to FIGS. 2 and 3.

FIG. 1 shows a flat, tubular section 1 with an expanded bottom square 2 that is folded into the plane of the flat, tubular section 1. Due to the formation of the bottom square, the corner flaps 4 have assumed shapes of isosceles triangles. The lateral regions of the bottom square, which are indicated by broken lines, form the lateral flaps 5 that are folded such that they overlap one another when the bottom is closed.

The outer side of the tubular section 1 is provided with a coating of thermoplastic such as PE. A patterned coating 6 of thermoplastic is also provided on the inner side of the right lateral flap 5 within the outer edge region. When bonding the folded bottom, the regions of the lateral flaps which are to be bonded together are heated such that the plastic coatings are plasticized and bonded together by folding the lateral flaps such that they overlap one another. The lateral flaps 5, when folded, are bonded both to one another and to the regions of the corner flaps that cover the lateral flaps.

The tubular sections 1 are continuously conveyed in the direction of the arrow A by two double-belt conveyors 7. Only the left conveyor of these double-belt conveyors is shown.

In order to fold the lateral flaps 5 such that they overlap, the ends of the tubular sections 1 which are provided with the bottom squares are pulled by the double-belt conveyors 7 over a table board 8 that is rigidly connected to the frame. The tubular section ends are pulled in such a way that the still open bottom squares 2 are conveyed underneath a blade-shaped straight edge 9. This straight edge is rigidly connected to the frame and has a cross section in the form of an isosceles triangle or trapezoid. The height of the cross section decreases in the conveying direction A. The lateral edges 10 and 11 of the straight edge 9 form folding edges. The lateral flaps 5 are folded around the folding edges such that they overlap during their continuous transport. Rods 12 fold the lateral flaps 5 around the folding edges 10 and 11 and press the lateral flaps against the upper side of the straight edge 9. These rods 12 are rigidly connected to the frame so as to realize the folding of the lateral flaps 5. The straight edge 9 is heated by heating rods (not shown) arranged in its interior.

A heated flat blade 14 is rigidly connected to the frame and engages between the lateral flaps 5 that are folded onto the straight edge 9 in overlapping fashion. This blade plasticizes the coating 6 and the coated region on the outer side of the overlapped lateral flaps 5. After the lateral flaps are folded such that they overlap, the closed bottom is introduced between a pair of pressing rollers 15. The regions provided with a plastic coating and to be bonded together are firmly pressed together such that a superior bond is attained. The upper roller of the pair of pressing rollers 15 is arranged on a spring-loaded lever. The upper roller is pressed elastically against the lower roller by the spring-loaded lever.

In order to prevent one side or half of the bottom that was folded into the plane of the flat, tubular section 1 from bonding to the adjacent coated section on the outer side of the tubular section 1, a separating plate 16 engages between the one bottom side and the adjacent region of the tubular section 1.

Figure 5:
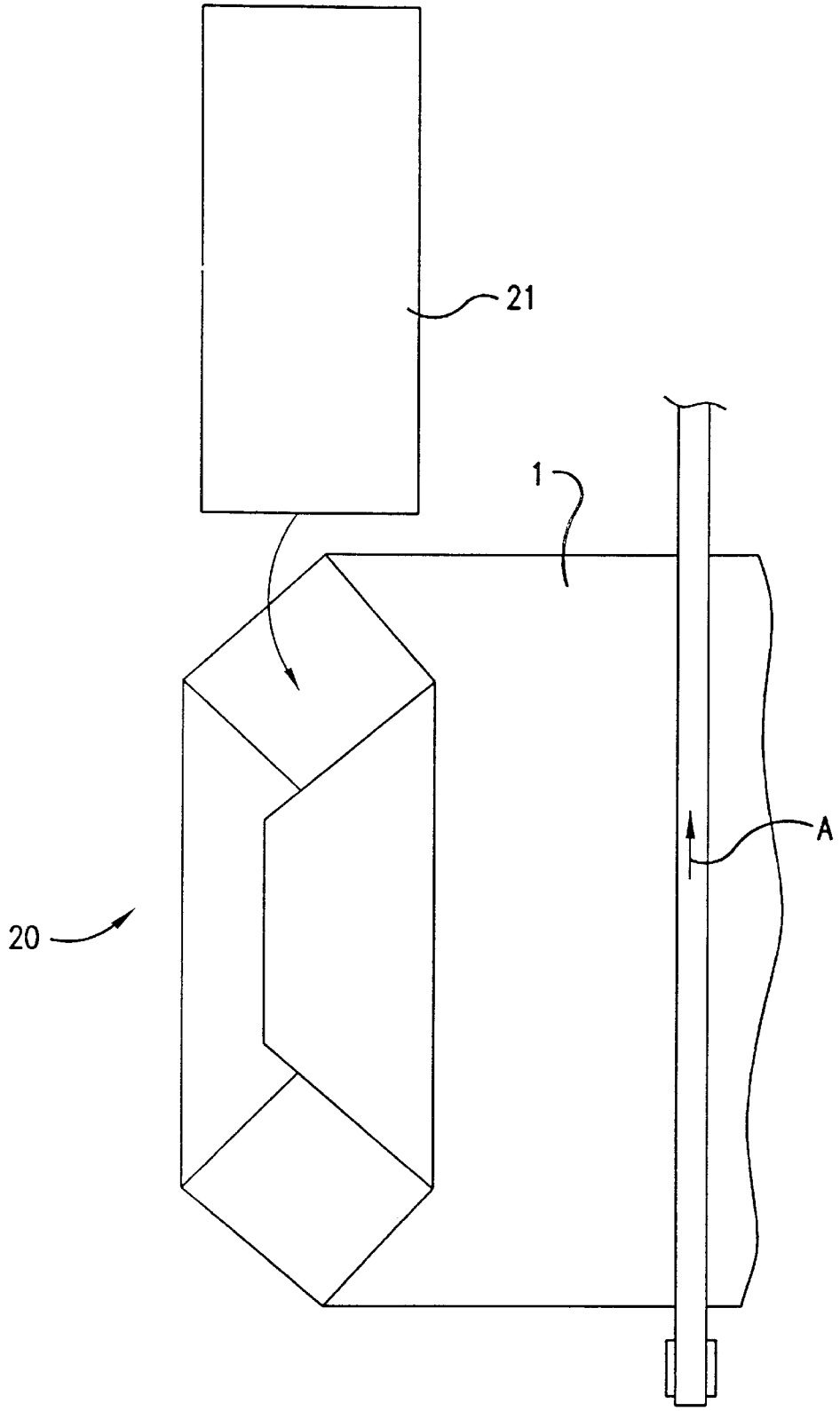
FIG. 5 is a top view of a transversely conveyed, flat tubular section with a folded bottom as well as a bottom cover sheet to be bonded to the bottom during the conveying process.
Figure 6:
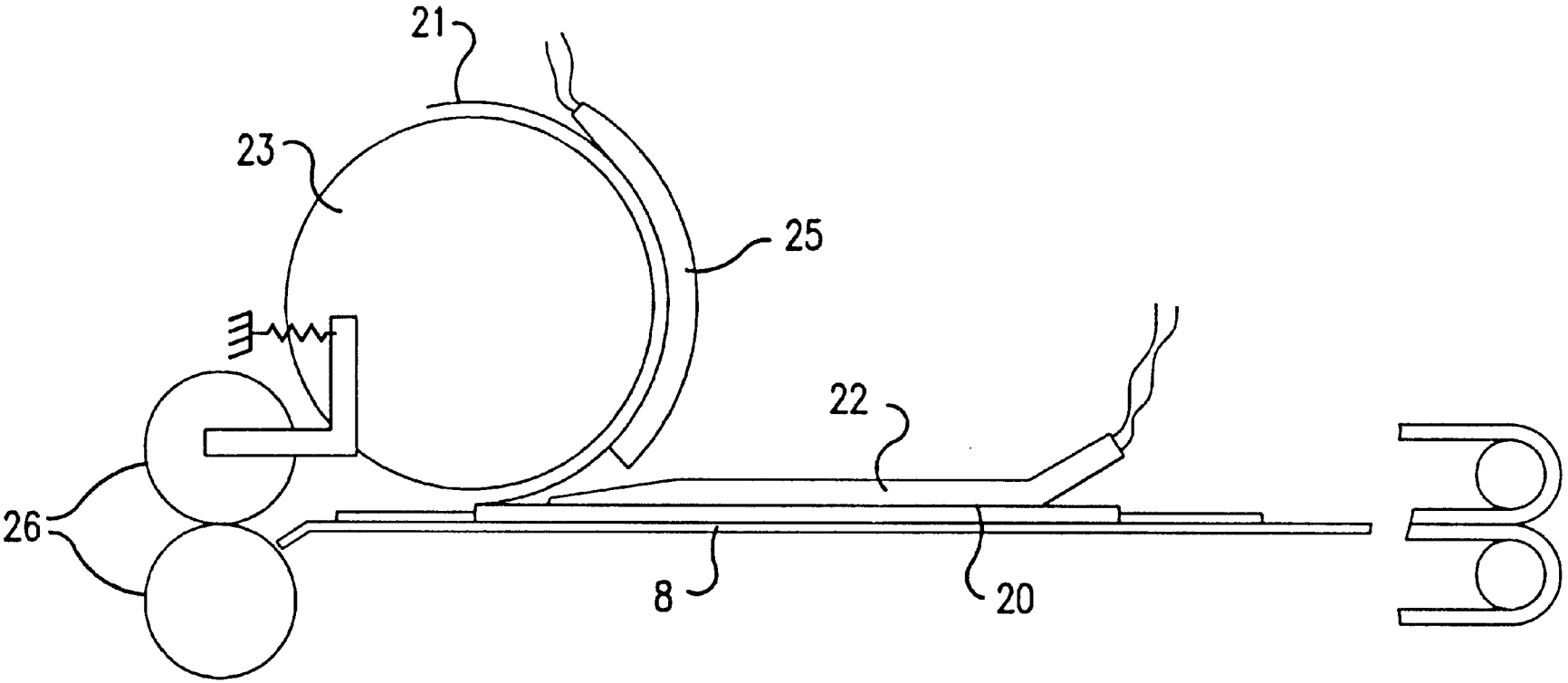
FIG. 6 is a device for applying a bottom cover sheet that was heated on one side onto the folded bottom of a continuously conveyed, flat tubular section.
Figure 7:
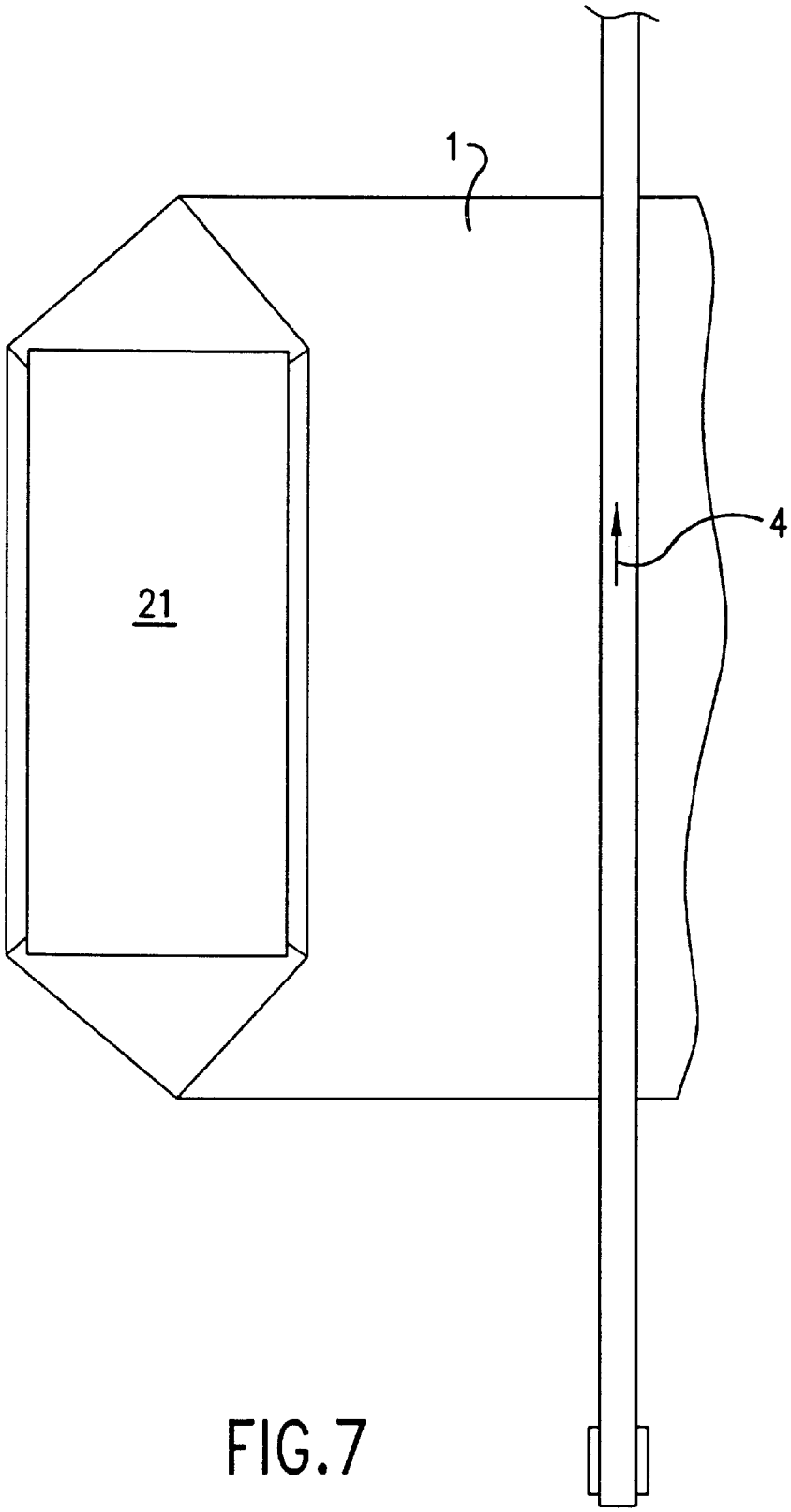
FIG. 7 is a top view of a transversely conveyed tubular section with a bottom cover sheet bonded to the folded bottom.

In the embodiment shown in FIGS. 5–7, a bottom cover sheet 21 is bonded to the closed bottom 20 that is folded into the plane of the flat, tubular section 1.

The outer side of the tubular section 1 is provided with a continuous coating of thermoplastic. In addition, the underside of the bottom cover sheet 21, which faces the bottom, is also provided with a coating of thermoplastic.

In order to plasticize the coatings to be bonded, the bottom that is flatly conveyed over the table board 8 passes underneath a heated plate 22. The heated plate 22 heats the coated upper side of the closed bottom and consequently plasticizes the upper side of the closed bottom which is provided with the plastic coating. After emerging from underneath the heated plate, a feed cylinder 23 with grippers (not shown) that hold the bottom cover sheet 21 presses the bottom cover sheet onto the closed bottom 20. In order to heat the coated side of the bottom cover sheet, the application cylinder 23 is provided with a heated, shell-shaped plate 25 over the part of its circumference which is shown. This plate is rigidly connected to the frame.

After pressing the bottom cover sheet 21 onto the closed bottom 20, the bottom is conveyed through a pair of pressing rollers 26. The upper roller of this pair of rollers is arranged on a spring-loaded lever.

FIG. 7 shows a tubular section 1 with a closed bottom and a bottom cover sheet 21 bonded thereto.

In the embodiment shown in FIGS. 8–13, the regions of the bottom which are to be bonded together are provided with patterns of thermoplastic.

Figure 8:
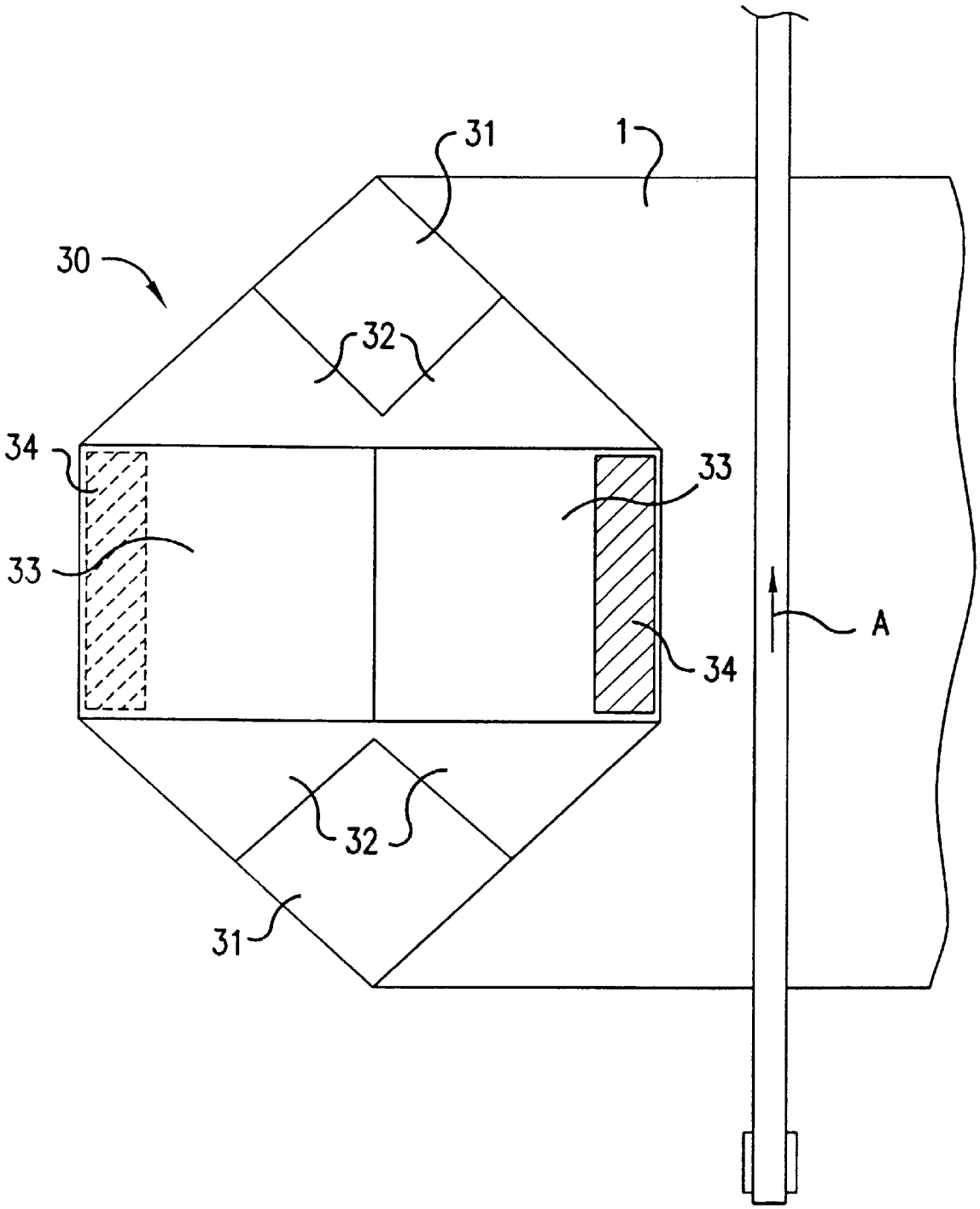
FIG. 8 is a top view of a transversely conveyed, tubular section with expanded bottom square, in which only the regions that are to be bonded together are provided with coatings of thermoplastic.

FIG. 8 shows a tubular paper section 1 that is conveyed in the direction of the arrow A and provided with an expanded bottom square 30 that is folded into the plane of the tubular section 1. The corner flaps 31 of the bottom square are provided with adjacent triangular coatings 32 of thermoplastic which are indicated by a gray tint. The lateral flaps 33 are provided with patterned plastic coatings 34 within their outer lateral regions or, more specifically, the inner side of the right lateral flap and the outer side of the left lateral flap.

Figure 9:
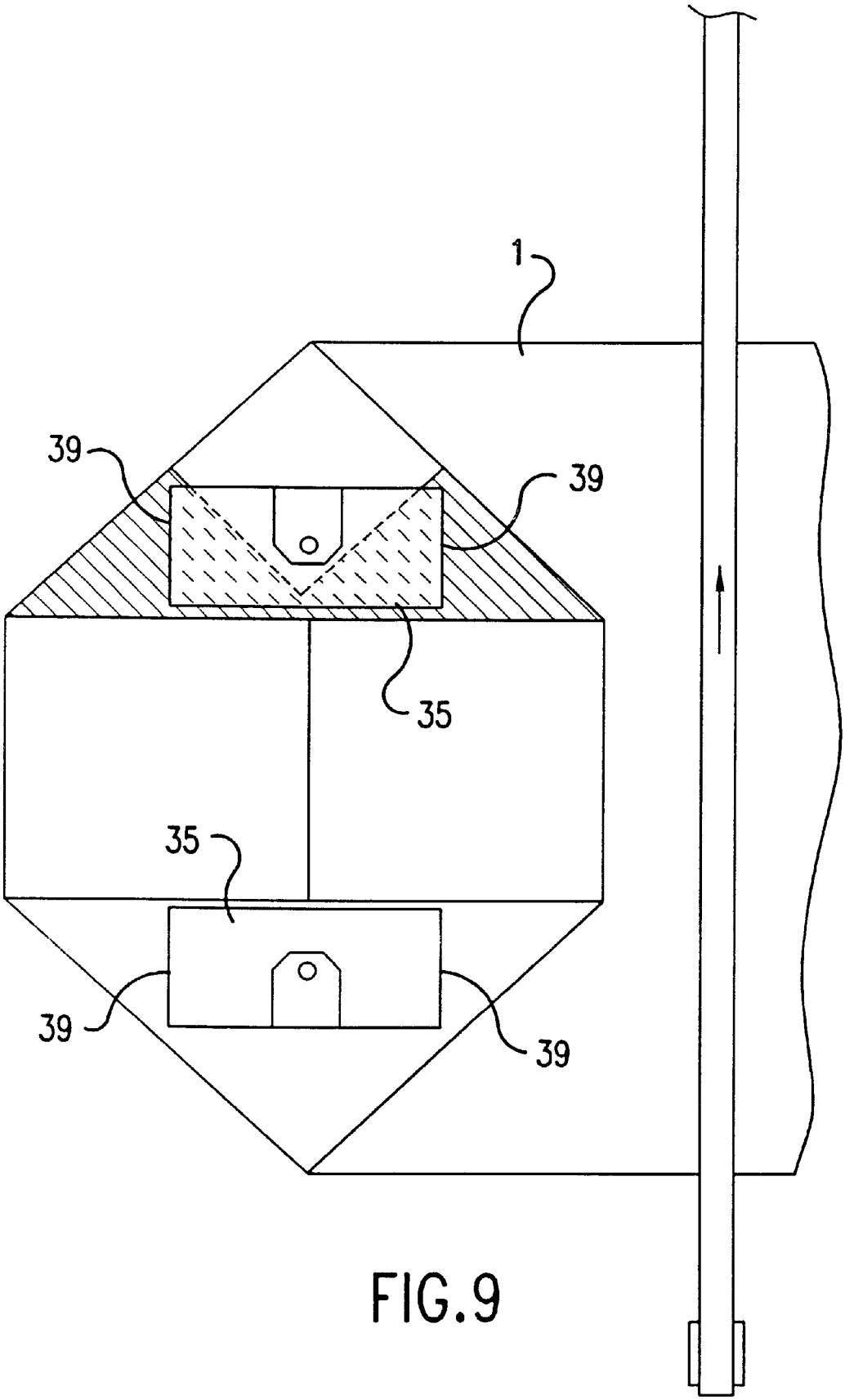
FIG. 9 is a schematic top view of the transversely conveyed bottom according to FIG. 8 with heated, synchronously conveyed format plates placed onto the corner flaps.
Figure 10:
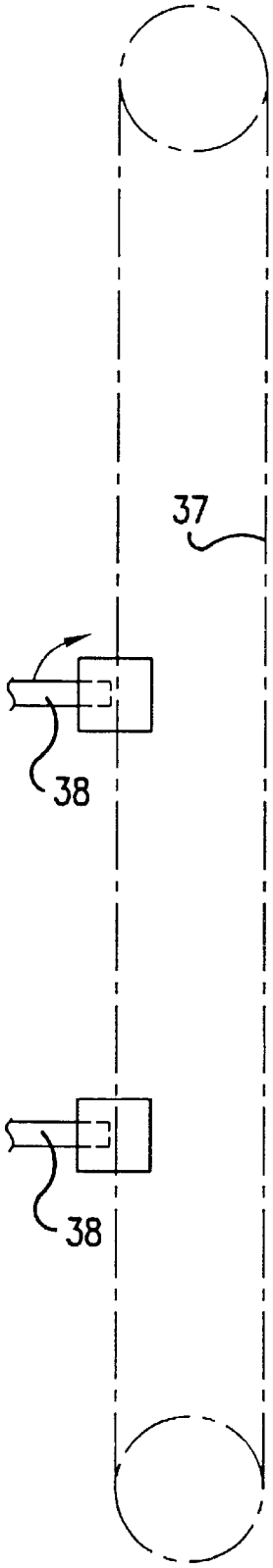
FIG. 10 is a side view of the holding dies for the heated format plates which revolve on an endless chain.
Figure 11:
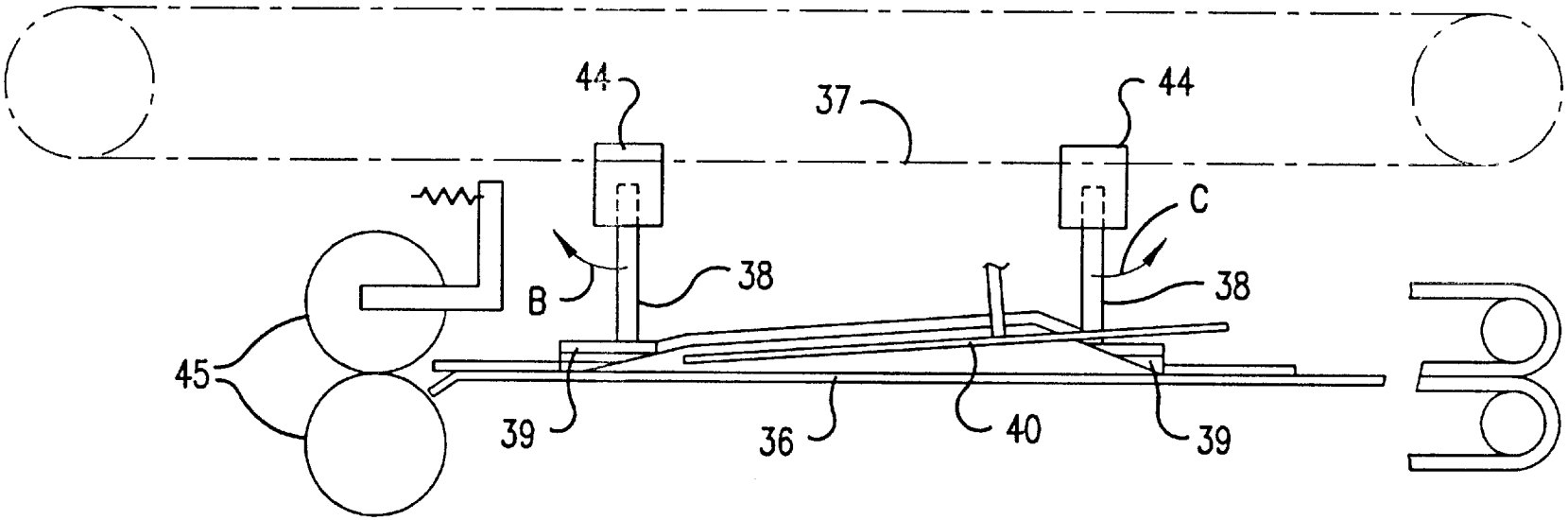
FIG. 11 is a schematic side view of the device according to FIGS. 9 and 10.

In order to heat the patterned coatings 32 on the corner flaps 31, heated, shoe-like format plates 35 are provided. These plates are mounted by dies 38 on an endless chain 37. The chain 37 revolves above the table plate 36. The format plates 35 revolve at a speed that corresponds to the transport speed of the tubular sections 1. The format plates 35 are centrally placed on the corner flaps 31 as shown in FIG. 9 such that the patterned plastic coatings 32 that are indicated by broken lines in FIG. 9 are heated. The lateral edges 39 of the format plates form folding edges. The lateral flaps 33 are folded around these edges by guide and pressing rods 40 that are rigidly connected to the frame. The upper side of the format plates 39 heats the outer regions of the patterned coatings 32 after folding the lateral flaps 33 such that they overlap one another. The coatings are bonded to one another and to the corresponding outer sides of the bottom which are also provided with patterned coatings.

Figure 12:
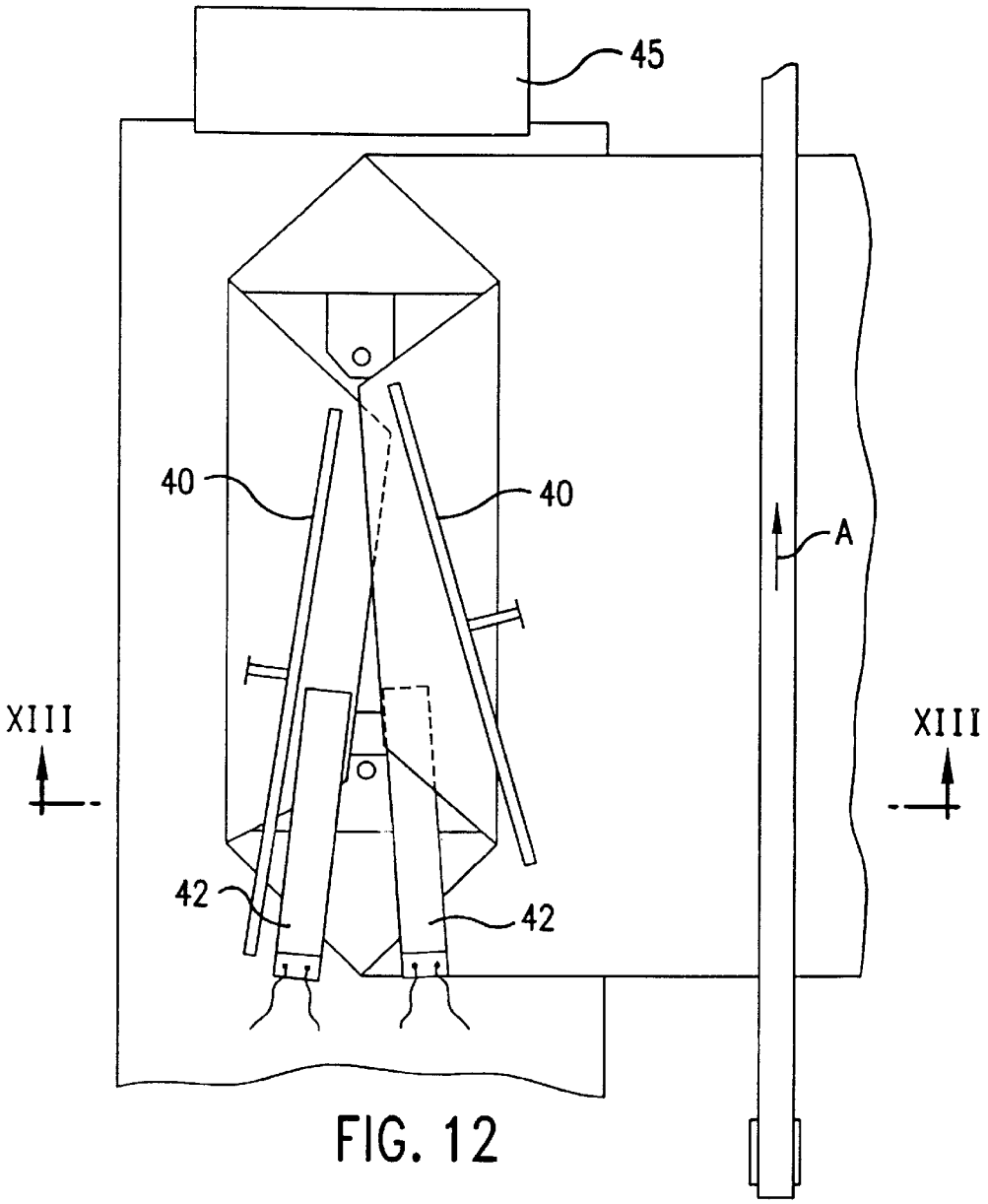
FIG. 12 is a schematic top view of the device according to FIG. 11.
Figure 13:
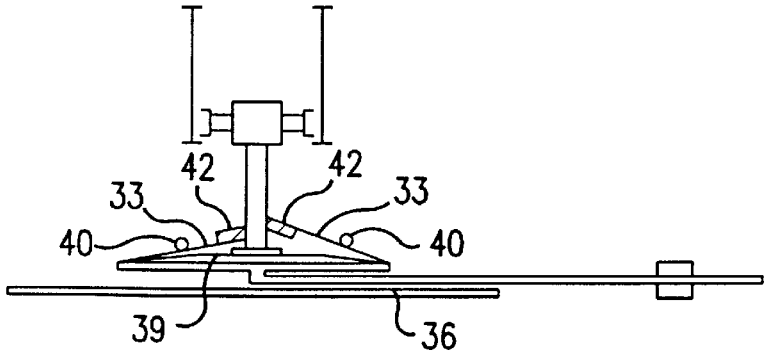
FIG. 13 is a section through the device according to FIG. 12 along line XIII—XIII.

Heated blades 42 that are rigidly connected to the frame are provided for heating the coated edge strips 34 of the lateral flaps. These blades heat the coatings 34 on the outer side and the inner side of the lateral flaps 33 as shown in FIG. 12.

The dies 38 are mounted in chain suspensions 44 in pivoted fashion. In this case, pivot drives are provided which swing the format plates 39 out of the closed bottom in the direction of the arrows B and C before the bottom is introduced into the gap between the pair of pressing rollers 45.

The device described previously with reference to FIGS. 10–13 can also be used when the entire outer sides of the tubular sections are provided with a coating of thermoplastic.

I claim:

1. In a method for manufacturing bags from flat, tubular single-layer or multilayer paper sections comprising the steps of expanding at least one end of each flat, tubular paper section into a bottom square, folding lateral flaps formed by expanding said at least one end such that they overlap one another and partially cover corner flaps, and bonding the lateral flaps together, an improvement comprising the steps of:

providing each of the tubular sections with a coating of thermoplastic on a first region of an inner side of one of said lateral flaps that is to be bonded together with another of said lateral flaps, continuously conveying each tubular section including said at least one end expanded into the bottom square such that a longitudinal axis of the tubular section extends transversely relative to a direction of conveyance, folding said lateral flats over so that said first region that is to be bonded together with the other of said lateral flaps overlaps a thermoplastic second region on an outer side of the other of the lateral flaps;

plasticizing the coating of thermoplastic provided on said first region of said inner side of said one of said lateral flats and the thermoplastic second region on the outer side of the other of said lateral flaps as said regions are conveyed past at least one heating device disposed between the regions, and tightly pressing said regions together to accomplish said bonding.

2. The improvement according to claim 1, wherein the providing step includes providing the inner side of said one of the lateral flaps with said coating of thermoplastic within its edge region.

3. The improvement according to claim 1, and further comprising the steps of pressing a side of a bottom cover sheet which is coated with a thermoplastic onto the lateral flaps after tightly pressing said regions together.

4. The improvement according to claim 1, wherein entire outer sides of the tubular sections are coated with thermoplastic.

5. The improvement according to claim 1, wherein the tubular sections are formed of a thermoplastic film.

6. The improvement according to claim 1, wherein the step of tightly pressing said regions together is performed by elastically pressing said regions together between first and second rollers.

* * * * *